US008272532B2

(12) United States Patent
Michaelian et al.

(10) Patent No.: US 8,272,532 B2
(45) Date of Patent: Sep. 25, 2012

(54) BEVERAGE CONTAINER LID

(75) Inventors: Peter Michaelian, Woodside, NY (US); Eric Freitag, New York, NY (US); Erica Eden, New York, NY (US); Dean DiPietro, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 1312 days.

(21) Appl. No.: 12/003,507

(22) Filed: Dec. 21, 2007

(65) Prior Publication Data

US 2009/0159595 A1 Jun. 25, 2009

(51) Int. Cl.
*A47G 19/22* (2006.01)
*F16K 39/02* (2006.01)

(52) U.S. Cl. ..... 220/715; 220/254.9; 220/716; 220/203.23; 220/203.29; 137/630.14; 137/630.15

(58) Field of Classification Search ..... 220/203.04, 220/203.07, 203.19, 203.23, 203.27, 203.29, 220/231, 367.1, 714, 715, 716; 215/311, 215/315, 387; 137/630, 630.14, 630.15
See application file for complete search history.

(56) References Cited

U.S. PATENT DOCUMENTS

| | | | | |
|---|---|---|---|---|
| 3,220,695 | A | 11/1965 | Downey et al. | |
| 3,739,938 | A | 6/1973 | Paz | |
| 3,967,748 | A | 7/1976 | Albert | |
| 4,094,433 | A | 6/1978 | Numbers | |
| 4,687,122 | A | 8/1987 | Bothun et al. | |
| 4,960,218 | A | 10/1990 | Toida et al. | |
| 5,332,127 | A | 7/1994 | White | |
| 5,427,271 | A | 6/1995 | Wang | |
| 5,435,470 | A | 7/1995 | Kim | |
| 5,495,966 | A | 3/1996 | Won | |
| 5,842,612 | A | 12/1998 | Won | |
| 5,875,941 | A | 3/1999 | Hsu | |
| 5,944,235 | A | 8/1999 | Won | |
| 6,098,834 | A * | 8/2000 | Hatsumoto et al. | 220/715 |
| 6,116,476 | A | 9/2000 | Huang | |
| 6,213,351 | B1 | 4/2001 | Stoneberg | |
| 6,299,027 | B1 | 10/2001 | Berge et al. | |
| 6,299,037 | B1 | 10/2001 | Lee | |
| 6,443,336 | B2 | 9/2002 | Antonetti et al. | |
| 6,662,978 | B2 | 12/2003 | Lin | |
| 6,702,138 | B1 * | 3/2004 | Bielecki et al. | 220/254.9 |
| 6,935,536 | B2 | 8/2005 | Tardif | |
| 6,938,794 | B2 | 9/2005 | Elder | |
| 7,073,678 | B1 | 7/2006 | Dibidin et al. | |
| 2002/0108959 | A1 | 8/2002 | Pollock | |
| 2005/0115977 | A1 * | 6/2005 | Dibdin et al. | 220/714 |
| 2006/0226160 | A1 | 10/2006 | Elsaden et al. | |
| 2007/0051723 | A1 | 3/2007 | Naesje | |
| 2007/0062906 | A1 | 3/2007 | Morano et al. | |
| 2007/0101868 | A1 | 5/2007 | Porter | |
| 2007/0210093 | A1 * | 9/2007 | Pinelli | 220/715 |

OTHER PUBLICATIONS

International Preliminary Report on Patentability dated Jul. 1, 2010 of Applicants' corresponding PCT application.

* cited by examiner

*Primary Examiner* — Anthony Stashick
*Assistant Examiner* — James N Smalley

(57) ABSTRACT

A beverage container lid for a container base having a reservoir, the lid comprising a shell removably mountable on the base comprising a first drink passage that extends through the shell and communicates with ambient and a cartridge removably engageable to the shell. A second drink passage is in communication with the first drink passage and is formed between an outer surface of the cartridge and inner surface of the shell. The cartridge comprises a valve that is moveable between an open condition and closed condition to control communication between the reservoir and second drink passage.

19 Claims, 8 Drawing Sheets

BEVERAGE CONTAINER LID

TECHNICAL FIELD OF THE INVENTION

The present device relates to a beverage container lid. In particular, the present device relates to an improved design for a beverage container lid adapted to permit liquid to be sealed or poured by actuation of a control.

BACKGROUND OF THE INVENTION

Beverage containers, sometimes referred to as "travel mugs" have become popular in recent years for use in vehicles or in other applications for users who like to drink when in motion, such as when walking or riding in a vehicle. The lids used with beverage containers are typically removable and designed to permit drinking from the reservoir in the container base, while, at the same time, inhibiting accidental spillage of the type which might result from the sloshing of the liquid contents.

Some beverage container lids have manual controls, such as a push button control, where simple actuation of the control can cause the lid to be in an open condition, to allow the liquid to flow through the lid so the user can drink, or a closed condition to cause the liquid to be sealed inside the container so accidental spills can be avoided. Known lid designs include a spring loaded cartridge having a toggle mechanism, whereby alternate pushes of the push button respectively cause a plunger valve to toggle between an open and closed condition.

There are several known disadvantages associated with known push button lids. For example, the drink passages inside known lid designs are inaccessible and therefore difficult to clean. While some designs may permit manual disengagement of some components, such as disengaging the lid from the base, when the components are disengaged, the walls of the drink passage remain substantially inaccessible. These known push button lids could be rendered unusable as residue from sugars, syrups or the like continue to build in the drink passage and cause the moveable components to stick.

Another disadvantage associated with known push button lids is that the plunger valve may be difficult to open when the container holds carbonated or hot beverages. This is due to pressure build-up from such beverages, which results in force acting against the plunger valve, and causing the valve to resist being moved towards an open condition.

The present device solves these and other problems associated with prior art devices.

SUMMARY OF THE INVENTION

There is disclosed herein an improved beverage container lid, which avoids the disadvantages of prior art devices while affording additional structural and operating advantages. The lid comprises a shell manually removably mountable on a base having a drinking surface formed on the upper surface of the shell and a first drink passage extending through the drinking surface. A cartridge having a cartridge housing and valve is removably engageable from the shell and disposed substantially inside the shell when engaged. A second drink passage is disposed substantially below the first drink passage and is in communication with the first drink passage, whereby liquids are permitted to pass through each.

It will be appreciated that the second drink passage is formed between an outer surface of the cartridge housing and inner surface of the shell. In particular, the second drink passage is formed between an inner passage wall, substantially formed from the outer surface of a cartridge housing, and an outer passage wall, substantially formed from the inner surface of the shell. When the cartridge is manually disengaged from the shell, the inner and outer passage walls, are substantially exposed and readily accessible for manual or automated cleaning.

The valve, movable between an open condition and a closed condition, may be in the form of a two-stage valve system having first and second gaskets that are movable between sealed and unsealed positions. When an opening action occurs, caused by actuation of a push button control, the valve moves to an open condition where the first and second gaskets are permitted to move to unsealed positions. When the valve is in the open condition, communication between the reservoir and second drink passage is permitted and the liquid contents may be poured. It will be appreciated when an opening action occurs, the second gasket is permitted to move to the unsealed position before the first gasket moves to the unsealed position. When the second gasket moves to the unsealed position, pressure may be released from the reservoir to the second drink passage. Less force is required to move the first gasket to the unsealed position after the aforementioned pressure release occurs. These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
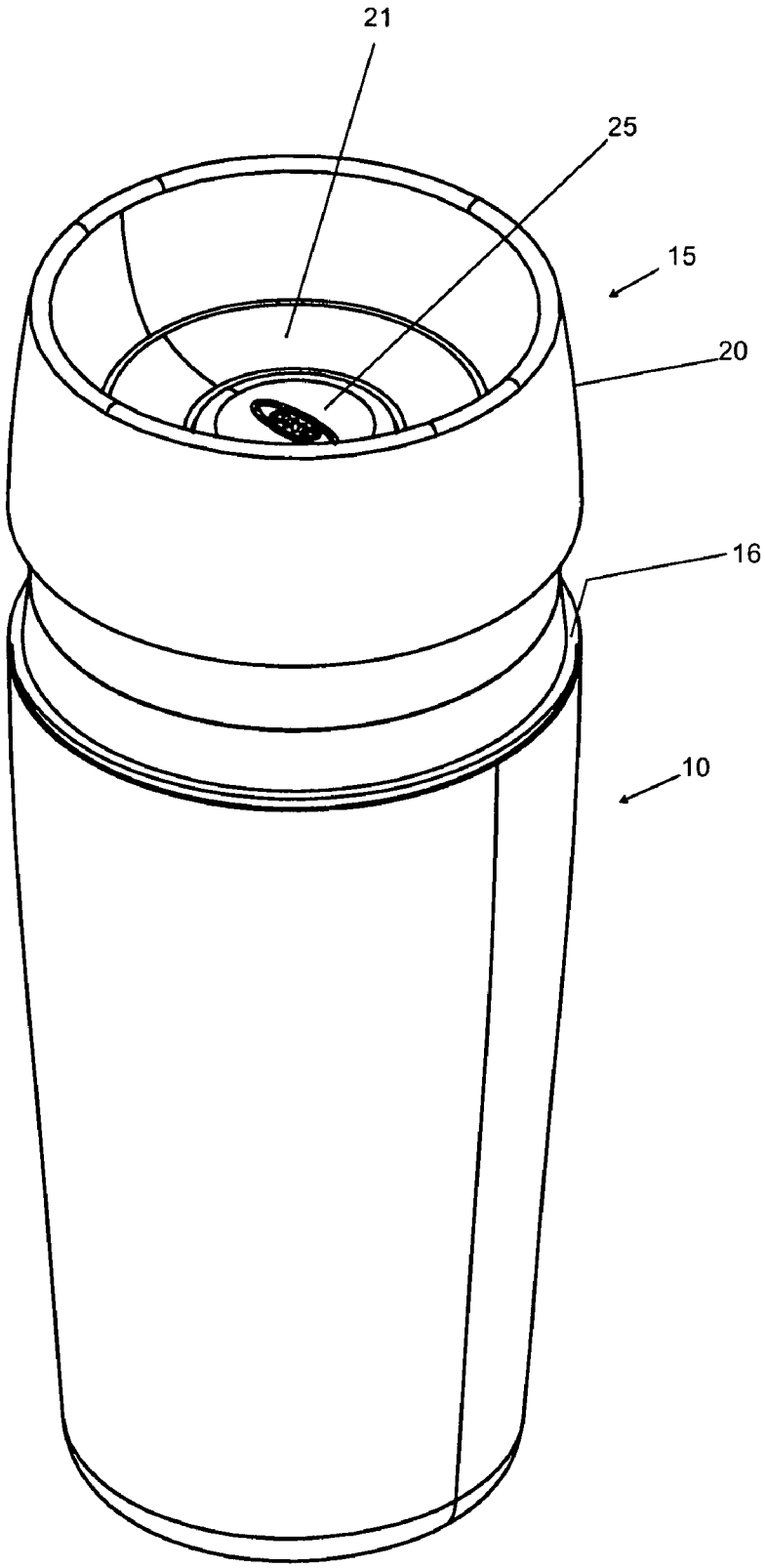
FIG. 1 is a top perspective view of one embodiment of the beverage container lid shown with the container base.
Figure 2:
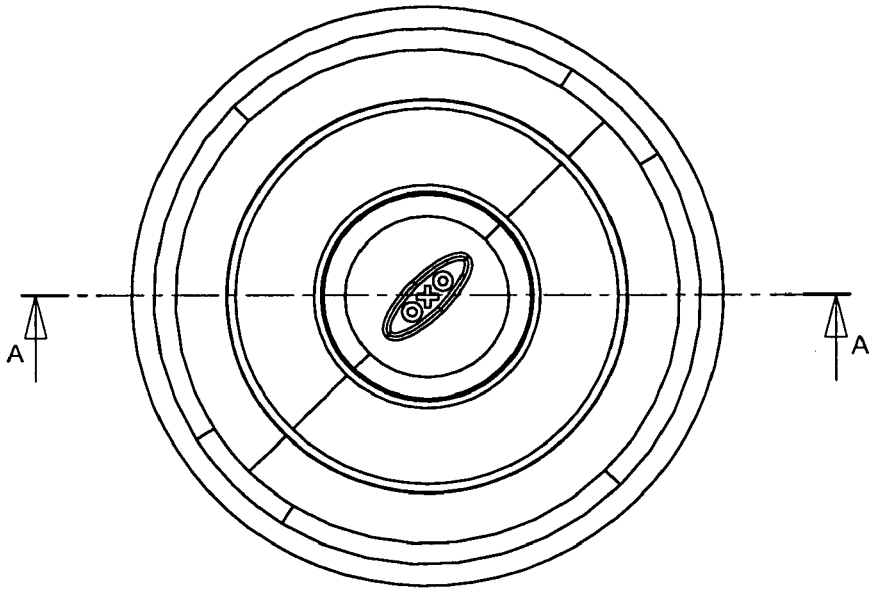
FIG. 2 is an enlarged top plan view of the lid of FIG. 1.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 1-8, there is illustrated a beverage container lid 15 to be used with a base 10 having a reservoir 12 for holding a variety of beverages, including hot beverages such as coffee or tea, or carbonated beverages such as cola. Unless otherwise stated herein, the components of the lid 15 of the present invention may be formed of substantially rigid plastic material well known in the art. The lid 15 includes a shell 20 and cartridge 22. Provided at the lower portion of the outer surface of the shell 20 is a thread 20*a*. The thread 20*a* of the shell 20 permits the lid 15 to be manually removably mountable on the base 10 through engagement with a thread (not shown) disposed at the upper surface of the inner wall of the base in a well known manner. A seal 40, made of elastomeric material, fits tightly around a shoulder portion of the shell 20. When the lid 15 is mounted on the base 10, the first gasket 40 sits against an upper rim 16 of the base 10 in a well known manner, to provide a water tight seal.

Figure 5:
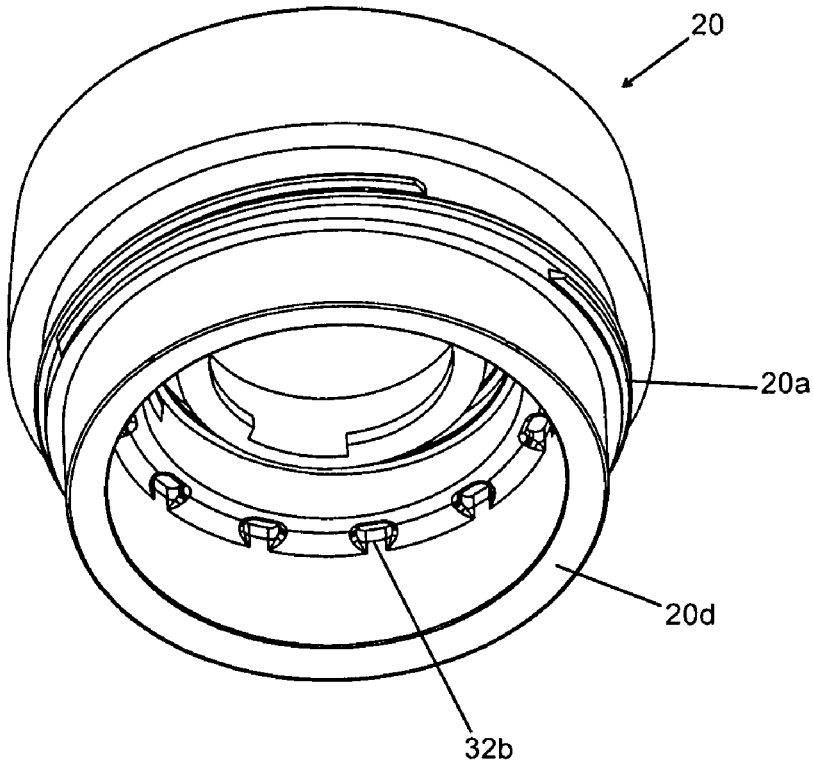
FIG. 5 is an enlarged, perspective view of the shell of FIG. 3.
Figure 6:
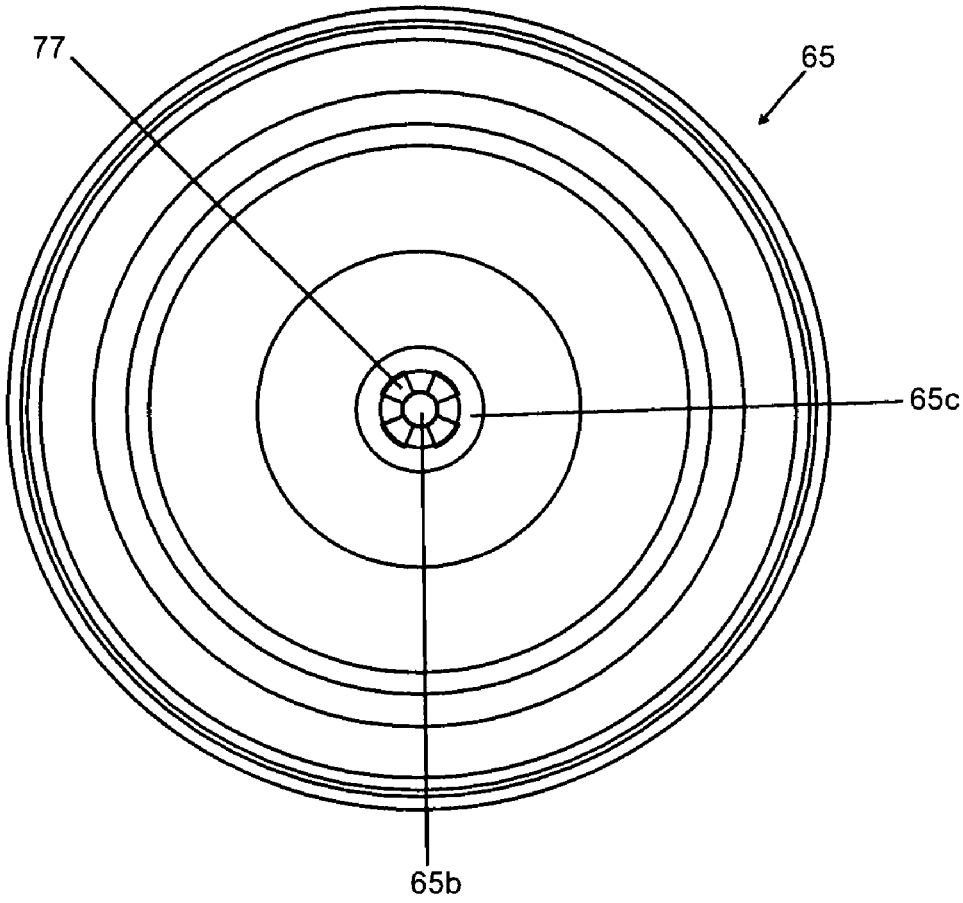
FIG. 6 is an enlarged, bottom view of the plate of FIG. 3.

The upper surface of the shell 20 forms a sloped drinking surface 20*b* and a first drink passage 32. The first drink passage 32 is molded within the shell 20 and is formed by the combination of a channel 32*a*, substantially cylindrical in form, that cuts through the drinking surface, and a plurality of equally spaced vertical openings 32*b* (shown most clearly in FIG. 5) disposed below the channel 32*a* and extending through the thickness of the shell 20 material. As shown in FIG. 5, the openings 32*b* are equally spaced and arranged in a circumferential manner to permit liquid flow regardless of the tilted pouring angle chosen by the user who desires to drink. A sloped, ring-like disk 21 is provided inside the hollow, central portion of the drinking surface 20*b* and partially covers the channel 32*a* of first drink passage 32. The disk 21 aids in guiding the liquid along the drinking surface 20*b* to prevent splashing of the liquid and permit easier drinking. The channel 32*a* and plurality of openings 32*b* may be formed from the same plastic mold used for the shell 20.

An inner surface of the shell 20 includes a thread 20*c* for engagement with a cartridge housing 24 for the cartridge 22. In particular, the cartridge housing 24 includes threads 24*a* formed on the outer surface of its upper portion. The housing threads 24*a* of the cartridge housing 24 may engage the inner threads 20*c* of the shell to permit the cartridge 22 to be manually removably engageable from the shell 20. When engaged, the cartridge housing 24 is substantially disposed inside the shell 20.

Figure 3:
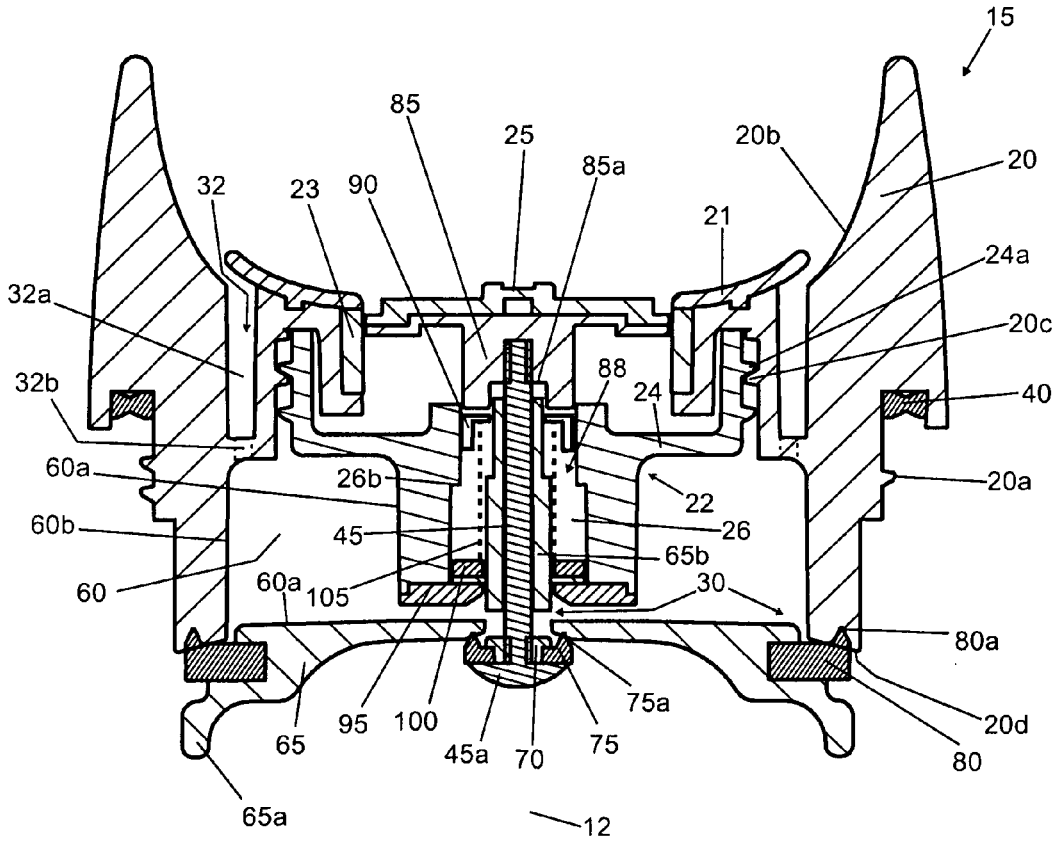
FIG. 3 is an enlarged sectional view of the lid in a closed condition taken generally along line A-A in FIG. 2.
Figure 4:
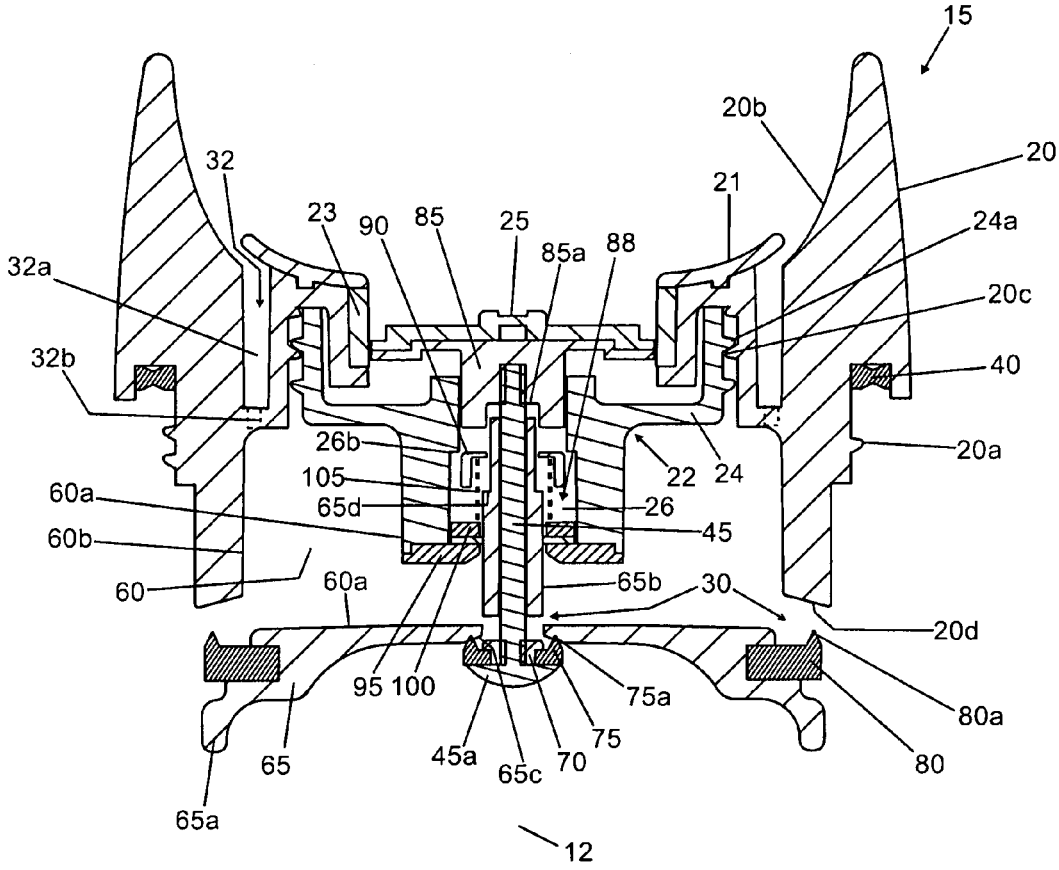
FIG. 4 is an enlarged sectional view similar to FIG. 3, but showing the lid in a open condition.

A second drink passage 60 is disposed substantially below and in communication with the openings 32*b* and channel 32*a* of the first drink passage 32, whereby liquids are permitted to pass through each. It will be appreciated that the second drink passage 60 is formed between an inner passage wall 60*a* and outer passage wall 60*b*. As shown in FIGS. 3-4, the inner passage wall 60*a* is formed from the combination of the inwardly and downwardly depending outer surface of the cartridge housing 24 and the upper surface of a plate 65. The outer passage wall 60*b* is formed from the inner surface of the lower portion of the shell 20. It will be appreciated that when the cartridge housing 24 is manually disengaged from the shell 20, the inner and outer passage surfaces 60*a*, 60*b* are substantially exposed and readily accessible for manual or automated cleaning. In particular, when the cartridge housing 24 is disengaged, beverage residue, such as sugar or syrup can be easily manually cleaned with a brush or towel or automatically cleaned with an automated dish washer.

To further facilitate manual engagement and disengagement between the cartridge 22 and shell 20, a gripping surface 65*a* is circumferentially provided at the lower portion of the plate 65, whereby a user may grip the gripping surface 65*a* to rotate the plate 65. As the plate 65 is rotated, the housing threads 24*a* of the cartridge housing 24 may engage or disengage from the inner threads 20*c* of the shell 20.

As shown in FIGS. 3-4, provided with the cartridge 22 is a valve 30 moveable between an open condition and closed condition to control communication between the reservoir 12 and ambient via the second drink passage 60. The valve 30 may be in the form of a two-stage valve system having first and second gaskets, 80, 75, respectively, constructed of an elastomer-like material or the like, and a stem 45 (resembling an upside-down bolt), having a lower end that forms a head 45*a* and an upper end fixed to a pusher 85 disposed near an upper surface of the shell 20. A shaft portion of the stem 45 slideably engages the inside of a vertical sleeve 65*b* that is disposed substantially above a center portion of the plate 65 and, which may be formed from the same mold as the plate 65.

The second gasket 75 fits tightly against an upper surface of the head 45*a*. A grommet 70 is provided to keep the second gasket 75 from moving relative to the head 45*a* in a well known manner. The upper portion of the second gasket 75 forms an annular ridge 75*a* adapted to engage an annular depression 65*c* (shown most clearly in FIGS. 4 and 6) formed in the center portion of the underside of the plate 65. A plurality of substantially equally spaced and circumferentially arranged bore holes 77 (shown in FIG. 6) extend vertically from the depression and through the thickness of the plate 65 to permit communication between the reservoir 12 and second drink passage 60.

During operation, vertical movement of the stem 45 causes the stem to slide relative to the sleeve 65*b* whereby the second gasket 75 moves between a sealed position and unsealed position. When the second gasket 75 is in the sealed position, the ridge 75*a* seals against the annular depression 65*c*, thereby preventing the bore holes 77 from providing communication between the reservoir 12 and second drink passage 60. When the second gasket 75 is in an unsealed position, the ridge 75*a* is disengaged from the annular depression 65*c*, thereby permitting communication between the reservoir 12 and ambient, via the second drink passage 60. When the second gasket 75 is in the unsealed position, pressure from the reservoir 12, caused by the presence of hot or carbonated beverages, may be released to the ambient via the second drink passage 60. It will be appreciated that the bore holes 77 are approximately 2 millimeters in diameter and may extend through other components and take a different path, so long as the pressure release described above is permitted.

As shown in FIGS. 3-4, the first gasket 80 fits tightly inside a circumferential groove formed on the upper surface of the plate 65, whereby the first gasket 80 is prevented from moving relative to the plate 65. The upper portion of the first gasket 80 forms a ridge 80*a* that is adapted to engage a rim 20*d* formed on an underside of the shell 20. Vertical movement of the stem 45 causes the first gasket 80 to move between a sealed position, when the valve 30 is in the closed condition (shown in FIG. 3) and an unsealed position, when the valve 30 is in the open condition (shown in FIG. 4). When the first gasket 80 is in the sealed position, the ridge 80*a* seals against the bottom rim 20*d*, thereby preventing communication between the reservoir 12 and second drink passage 60. When the first gasket 80 is in the unsealed position, the ridge 80*a* is disengaged from the rim 20*d*, thereby permitting communication between the reservoir 12 and second drink passage 60.

The lid 15 is provided with a manually operated control 25, which may be in the form of a push button or the like. The control 25 is accessible through an aperture in the shell 20. Depression of the control 25 causes the pusher 85 and stem 45 to move in a downward direction. The control 25 triggers a toggle mechanism 88 that is substantially disposed inside the cartridge housing 24. The toggle mechanism 88 is adapted to permit the control 25 to sequentially toggle between an opening action, wherein actuation of the control 25 causes the valve 30 to move from the closed condition to the open condition, and a closing action, wherein actuation of the control 25 causes the valve 30 to move from the open condition to the closed condition.

Figure 7:
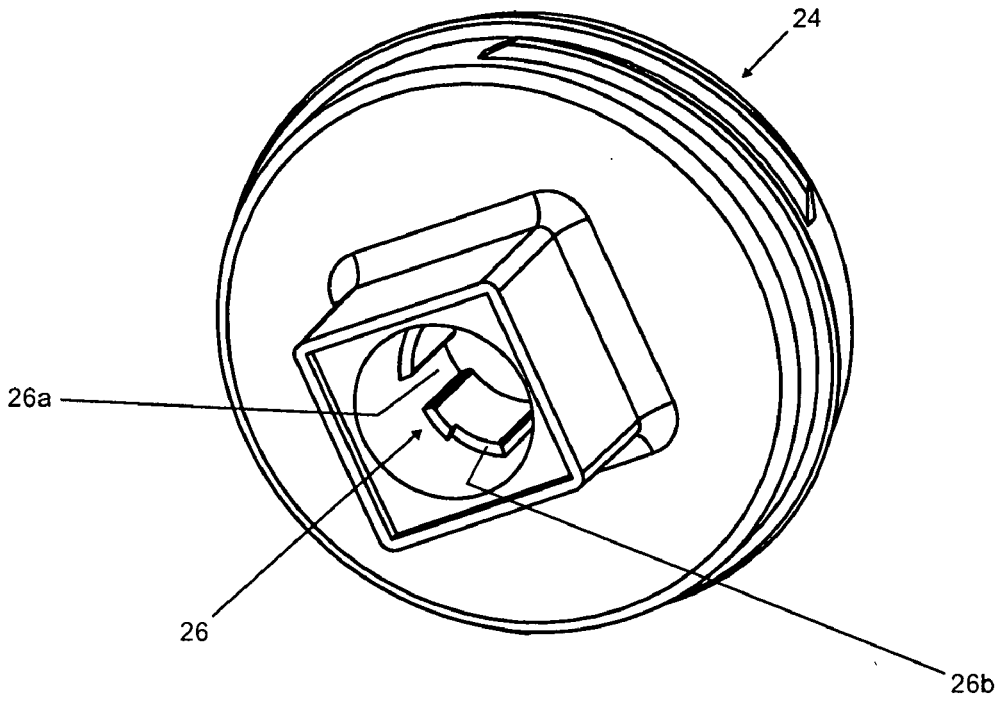
FIG. 7 is an enlarged, perspective view of the cartridge housing of FIG. 3.
Figure 8:
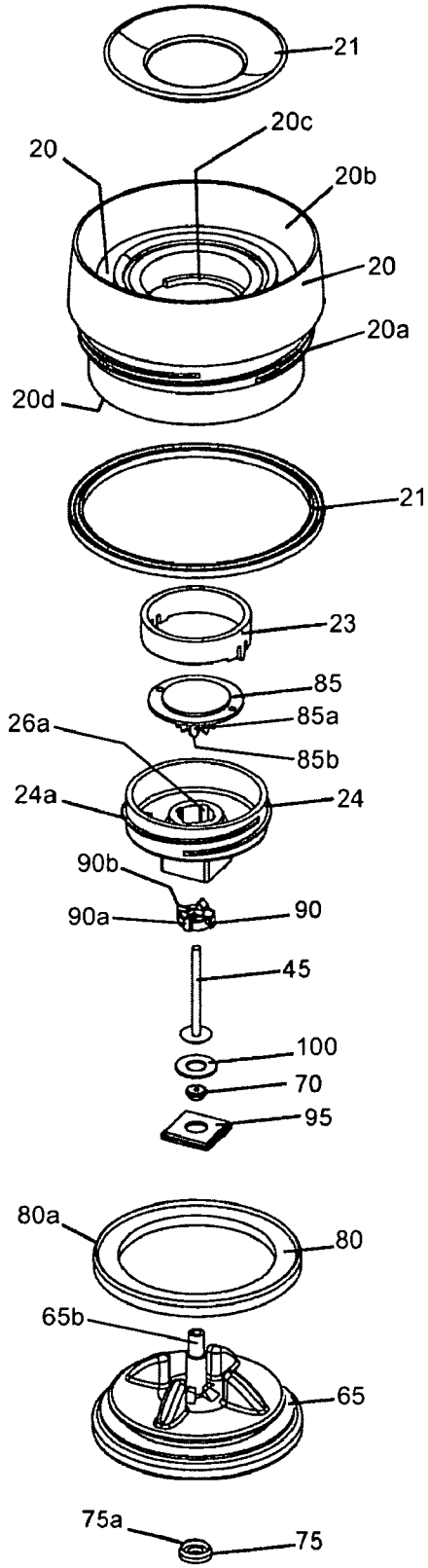
FIG. 8 is an enlarged, exploded, perspective view of the lid of FIG. 3.

The toggle mechanism 88 is a known type of toggle mechanism which latches the valve 30 alternately in open and closed conditions with alternate depressions of the pusher 85. Certain components of the toggle mechanism 88 are also disclosed in U.S. Pat. No. 7,073,678, which is incorporated by reference herein. As shown in FIGS. 3-4 and 7, the toggle mechanism 88 includes a generally cylindrical turret 26 formed within the cartridge housing 24 and having four equally spaced-apart vertically oriented grooves 26*a* and an annular shoulder 26*b* formed below the grooves 26*a*. As shown in FIGS. 3-4, provided in the turret 26 is a helical compression spring 105 that encircles the sleeve 65*b*. The spring 105 is seated on a washer 100, preferably made of silicone, which is seated on an annular cap 95 fixed to an underside of the cartridge housing 24. The cap 95 and washer 100 combine to effectuate fluid-tight sealing engagement with the sleeve 65*b*, which prevents liquid from passing into the turret 26 and accessing the components disposed therein, such as the spring 105. Also provided in the turret 26 is a spinner 90, which rests atop the upper end of the spring 105. The spinner 90 preferably has four equally spaced-apart, laterally outwardly projecting arms 90*a*, each provided with an angled first cam surface 90*b* (shown in FIG. 8) at its upper end. Each of the arms 90*a* is adapted to slideably engage the grooves 26*a* formed on the outer wall of the turret 26. The toggle mechanism 88 also includes the pusher 85, which may be of molded, one-piece plastic construction, and preferably includes four equally spaced-apart, and longitudinally extending external ribs 85*a*, each provided with an angled second cam surface 85*b* (shown in FIG. 8) adapted for camming engagement with the first cam surfaces 90*a* of the spinner 90. The ribs 85*a* of the pusher also engage the grooves 26*a* and prevent the pusher 85 from rotating relative to the turret 26.

When the control 25 is depressed, the pusher 85 and stem 45 move downwardly, pushing the spinner 90 downwardly relative to the turret 26 until the arms 90*a* clear the lower ends of the grooves 26*a* and the shoulder 26*b*, whereupon the camming engagement of the first and second cam surfaces 90*b*, 85*b* causes the spinner 90 to rotate 45 degrees. After the opening action is complete, the spinner 90 will have rotated 45 degrees, causing the upper surface of the arms 90*a* to be out of alignment with the grooves 26*a* and stopped against the shoulder 26*b*, causing the spring 105 to remain in a compressed state and preventing the spinner 90 from returning to its original position. As shown in FIG. 4, after an opening action occurs, the spinner 90 holds the valve 30 in an open condition so, for example, the valve 30 does not accidentally slide to the closed position when user turns the lid 15 upside-down to take a drink. In particular, when the upper surfaces of the spinner arms 90*a* are held below the shoulder 26*b*, the lower surfaces of the spinner arms 90*b* engage an intermediate step 65*d* disposed halfway up the sleeve 65*c*, thereby preventing the stem 65*b* and plate 65 from sliding in an upward direction relative to the shell 20.

A subsequent depression of the control 25 causes the spinner 90 to rotate 45 degrees once again, whereby the arms 90*a* are permitted to re-engage the grooves, to thereby return the spinner 90*a*, stem 45 and plate 65 back to their original positions where the valve 30 is in a closed condition.

A collar 23 is provided around the circumference of the button 25 and pusher 85. The collar 23 is colored differently than the rest of the surrounding components so that the collar 23 can be plainly visible after an opening action has occurred to warn the user that liquid contents can be released from the reservoir 12 to the drinking surface 20*b*. For example, the collar 23 may be colored orange, whereby a user would see orange after an opening action has occurred.

In operation, when an opening action occurs, the stem 45 moves in a downward direction, thereby causing the second gasket 75 to move to the unsealed position, whereby pressure may be released from the reservoir 12 to the ambient via the second drink passage 60. It will be appreciated that in cases where the reservoir 12 is pressurized (from heated or carbonated beverages or the like), the second gasket 75 will be permitted to move to the unsealed position before the first gasket 80 is permitted to move to the unsealed position. In that regard, when the downward movement occurs and the reservoir 12 is pressurized, the plate 60 and first gasket 80 will meet more pressure resistance than the smaller stem head 45*a* and second gasket 75. As such, the second gasket 75 permits a pressure release, which makes it so that less force is required for the first gasket 80 to move towards the unsealed position. It will also be appreciated that after the aforementioned pressure release occurs, the force of gravity may cause the plate 60 to slide relative to the stem 45 in a downward direction until the depression 65*c* of the plate 65 rests atop the second gasket 75. In other cases, the plate may be forced in a downward direction by a ledge 85*a* formed from an underside of the pusher 85. In particular, the stem 45 and second gasket 75 are permitted to slide relative to the sleeve 65*b* until the gap between the ledge 85 and sleeve 65*b* has closed, whereupon the ledge 85*a* presses downward against a top surface of the sleeve 65*b* to force the plate 65 in a downward direction, thereby causing the second gasket 80 move to the unsealed position The matter set forth in the foregoing description and accompanying drawings is offered by way of illustration only and not as a limitation. While particular embodiments have been shown and described, it will be apparent to those skilled in the art that changes and may be made without departing from the broader aspects of applicants' contribution. The actual scope of the protection sought is intended to be defined in the following claims when viewed in their proper perspective based on the prior art.

What is claimed is:

1. A beverage container lid for a container base having a reservoir, the lid comprising:

a shell removably mountable on the base comprising a sloped drinking surface and first drink passage below the drinking surface, the first drink passage extends through the shell and communicates with ambient;

a plate removably engageable to the shell; and a second drink passage in communication with the first drink passage, the second drink passage being formed between an upper surface of the plate and an inner surface of the shell when the plate is engaged to the shell;

wherein the plate is moveable between an open condition and a closed condition to control communication between the reservoir and second drink passage when the plate is engaged to the shell;

wherein the plate includes a bore extending through the plate.

2. The beverage container lid of claim 1 further comprising a manually operated control having a toggle mechanism adapted to permit the control to sequentially toggle between an opening action, wherein actuation of the control causes the plate to move from the closed condition to the open condition, and a closing action, wherein actuation of the control causes the plate to move from the open condition to the closed condition.

3. The beverage container lid of claim 1 wherein when the plate is disengaged from the shell, the upper surface of the plate and the inner surface of the shell are substantially exposed to permit access for manual cleaning.

4. The beverage container lid of claim 3 wherein the plate further comprises a gripping surface to facilitate manual removable engagement between the cartridge and shell.

5. A beverage container lid for a container base having a reservoir, the lid comprising:

a shell mountable on the base comprising a first drink passage that extends through the shell and communicates with ambient;

a second drink passage in communication with the first drink passage;

a cartridge engageable to the shell and having a valve moveable between an open condition and closed condition to control communication between the reservoir and the second drink passage;

a manually operated control; and a toggle mechanism adapted to permit the control to sequentially toggle between an opening action, wherein actuation of the control causes the valve to move from a closed condition to an open condition, and a closing action, wherein actuation of the control causes the valve to move from an open condition to a closed condition; wherein the valve comprises first and second gaskets each movable between a sealed and unsealed position, wherein when an opening action occurs, the second gasket is permitted to move to the unsealed position before the first gasket moves to the unsealed position, wherein the valve further comprises a plate having a bore that extends through the plate to permit communication between the reservoir and second drink passage.

6. The beverage container lid of claim 5 wherein when the first and second gaskets are in the sealed position, the second gasket is sealed against an underside of the plate, thereby preventing communication between the reservoir and bore, and the first gasket is sealed against a rim formed on an underside of the shell, thereby preventing communication between the reservoir and second drink passage.

7. The beverage container lid of claim 5 wherein the shell is removably mountable on the base.

8. The beverage container lid of claim 5 wherein the cartridge is removably engageable to the shell.

9. The beverage container lid of claim 1 further comprising:

a pusher disposed near an upper surface of the shell;

a stem extending through the bore and connecting the plate to the pusher, wherein vertical movement of the stem via actuation of the pusher results in vertical movement of the plate.

10. The beverage container lid of claim 1 wherein the shell includes a plurality of openings arranged in a circumferential manner to permit liquid flow therethrough regardless of a tilted pouring angle chosen by a user who desires a drink, the openings being in communication with the first passage and the second passage.

11. The beverage container of claim 10 wherein the openings are disposed above the plate and between the first passage and the second passage.

12. A beverage container lid for a container base having a reservoir, the lid comprising:

a shell removably mountable on the base comprising a first drink passage including a channel and a plurality of openings disposed below the channel, the first drink passage communicating with ambient, each of the openings being arranged in a circumferential manner to permit liquid flow therethrough regardless of a tilted pouring angle;

a plate removably engageable with the shell, the plate being moveable with respect to the shell when the plate is engaged with the shell;

a second drink passage in communication with the openings, the second drink passage being formed between a surface of the plate and an inner surface of the shell when the plate is engaged with the shell;

a gasket disposed between the shell and the plate when the plate is engaged with the shell, wherein the plate presses the gasket against a rim formed on an underside of the shell below the openings when the plate is in a closed position;

a manually operated push button connected with the plate when the plate is engaged with the shell, wherein vertical movement of the push button results in movement of the plate with respect to the shell between an open position and the closed position, when in the open position fluid is able to pass from the reservoir into the second passage, when in the closed position fluid is precluded from passing from the reservoir into the second passage.

13. The beverage container of claim 12 wherein the gasket is attached to the plate for movement therewith.

14. The beverage container of claim 12 wherein the gasket and the plate are disposed below the openings when the plate is engaged with the shell.

15. The beverage container lid of claim 12 further comprising a stem connecting the plate to the push button when the plate is engaged with the shell, wherein the plate includes a bore and the stem extends through the bore.

16. The beverage container lid of claim 15 further comprising another gasket connected with the stem, wherein the another gasket moves to an unsealed position to permit communication between the reservoir and the second drink passage through the bore in the plate.

17. A beverage container lid for a container base having a reservoir, the lid comprising:

a shell removably mountable on the base comprising a sloped drinking surface and first drink passage below the drinking surface, the first drink passage extends through the shell and communicates with ambient;

a plate removably engageable to the shell; and a second drink passage in communication with the first drink passage, the second drink passage being formed between an upper surface of the plate and an inner surface of the shell when the plate is engaged to the shell;

wherein the plate is moveable between an open condition and a closed condition to control communication between the reservoir and second drink passage when the plate is engaged to the shell, wherein the shell includes a plurality of openings arranged in a circumferential manner to permit liquid flow therethrough regardless of a tilted pouring angle chosen by a user who desires a drink, the openings being in communication with the first passage and the second passage.

18. The beverage container of claim 17 wherein the openings are disposed above the plate and between the first passage and the second passage.

19. A beverage container lid for a container base having a reservoir, the lid comprising:

a shell removably mountable on the base comprising a sloped drinking surface and first drink passage below the drinking surface, the first drink passage extends through the shell and communicates with ambient;

a cartridge including a plate removably engageable to the shell, wherein the plate is manually disengageable from the shell via a threaded connection, wherein the cartridge includes a cartridge housing including a housing thread, wherein the shell includes a shell thread, wherein the housing thread is removably engageable to the shell thread; and a second drink passage in communication with the first drink passage, the second drink passage being formed between an upper surface of the plate and an inner surface of the shell when the plate is engaged to the shell;

wherein the plate is moveable between an open condition and a closed condition to control communication between the reservoir and second drink passage when the plate is engaged to the shell.

* * * * *